US006659320B1

(12) United States Patent
Alves et al.

(10) Patent No.: US 6,659,320 B1
(45) **Date of Patent: *Dec. 9, 2003**

(54) ENCLOSURE FOR CD OR CD PLAYER, ATTACHABLE TO A CARRIER OR CARRIERS

(75) Inventors: Kasidy W. Alves, Oxnard, CA (US); Michael J. Massett, Moorpark, CA (US)

(73) Assignee: Scosche Industries, Inc., Oxnard, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/858,524

(22) Filed: May 17, 2001

(51) Int. Cl.[7] ..... A45C 15/00

(52) U.S. Cl. ..... 224/581; 224/583; 224/605; 224/649; 224/652; 224/653; 224/930; D3/218

(58) Field of Search ..... 224/581, 583, 224/605, 649, 652, 653, 657, 930; D3/215, 218, 226, 232, 233; D6/407, 631–634, 635

(56) References Cited

U.S. PATENT DOCUMENTS 4,081,061 A * 3/1978 Tucker ..... 190/108
4,883,207 A * 11/1989 McArthur ..... 190/113
5,004,105 A * 4/1991 Freadman ..... 206/320
5,004,134 A * 4/1991 Barry ..... 224/235
D351,943 S * 11/1994 Young ..... D3/216
D372,623 S 8/1996 Alves et al.
D382,166 S 8/1997 Alves et al.
D382,527 S 8/1997 Alves et al.
D382,703 S 8/1997 Alves et al.
D386,467 S 11/1997 Alves et al.
D389,001 S 1/1998 Alves
D393,947 S 5/1998 Alves et al.
D394,579 S * 5/1998 Kazanowski ..... D6/630
5,749,503 A * 5/1998 Wulf et al. ..... 190/18 A
5,769,295 A 6/1998 Alves
5,808,865 A 9/1998 Alves
D401,406 S 11/1998 Alves et al.
D402,810 S 12/1998 Alves
5,897,042 A * 4/1999 Sims ..... 206/457
6,006,915 A * 12/1999 Moor ..... 190/102
D427,766 S * 7/2000 Hillman ..... D3/218
D428,700 S * 8/2000 Hillman ..... D3/201
D429,065 S * 8/2000 Hillman ..... D3/218
D433,008 S 10/2000 Pardo
6,345,751 B1 * 2/2002 Elliot ..... 224/640
D463,660 S 10/2002 Alves et al.

* cited by examiner

*Primary Examiner*—Stephen K. Cronin
(74) *Attorney, Agent, or Firm*—William W. Haefliger

(57) ABSTRACT

In combination a carrier pack, with an enclosure for a device comprising at least one of the following: a compact disc or discs, a compact disc player, a component or components related to a disc or a player, with attachment structure on the pack and on the enclosure whereby the enclosure can be removably attached to, or removed from the pack.

34 Claims, 10 Drawing Sheets

ENCLOSURE FOR CD OR CD PLAYER, ATTACHABLE TO A CARRIER OR CARRIERS

BACKGROUND OF THE INVENTION

This invention relates generally to transport and use of a protective case for electrical structures, as for example compact discs, and a player for such discs; and more particularly concerns a case or enclosure readily attachable to a carrier such as a back pack, hand bag, or a cooler, or other carrier equipment.

Compact disc players including drives are connectable to speaker units, and operable to transmit audio signals between the player and speaker, as via wiring. Previously, it was known to transport or move the player while it was not protected, or if the player was carried in a transport receptacle, it had to be removed from the receptacle or enclosure, for use. In either event, the player became unprotected at some point between its transportation and use. Accordingly, there is need to provide means whereby the player, may remain protected during both transportation and use, as in a case.

Also there is need for an enclosure having the advantageous attachment functions, and equipment transport functions, and affording the surprising results, that are now enabled or provided by the present invention.

SUMMARY OF THE INVENTION

It is a major object of the invention to provide a highly useful combination that includes a) an enclosure for a device comprising at least one of the following:
   $x_1$) a compact disc or discs,
   $x_2$) a compact disc player,
   $X_3$) a component or components related to the disc or the player,
b) attachment structure on the enclosure, whereby the enclosure can be attached to or removed from a carrier.

As will be seen, the attachment structure typically includes a first zipper and a first zipper track on the enclosure to be track connected to a first zipper track on a carrier, such as a back pack, luggage bag, cooler, etc.

Another object is to provide an enclosure as referred to which has a wall to face the carrier, the wall having a periphery, and wherein the first zipper track extends about said periphery.

A further object is to provide an enclosure having two sections that are relatively openable for allowing reception of the device to be transported into the interior of the enclosure, and for removal of the device from the interior.

An additional object is to provide first attachment structure including a first zipper and first zipper tracks on the enclosure and on the pack; and also to provide second attachment structure including a second zipper and second zipper tracks on two sections of the enclosure, whereby the enclosure can be opened while it remains attached to the carrier. As will be seen, for compactness while affording multiple functions, the first and second zipper tracks preferably extend in generally parallel, spaced relation. In this regard, one enclosure section typically has a wall extending between the first and second zipper tracks, and a through opening is provided in that wall for passing wiring that allows electrical communication between the device in the enclosure and an electrically operable speaker unit outside the enclosure, all without requiring opening of the enclosure or its detachment from the carrier. The speaker may be incorporated in a head set, and a retainer is preferably provided on the enclosure, to removably support the head set.

Further objects include provision of an enclosure as referred to, that consists of flexible material; the provision of a carrier as referred to in the form of a back pack; the provision of a carrier in the form of a cooler; the provision of multiple carriers, to which any of the enclosures may be attached by first zipper structure, as referred to.

These and other objects and advantages of the invention, as well as the details of an illustrative embodiment, will be more fully understood from the following specification and drawings, in which:

DRAWING DESCRIPTION

DETAILED DESCRIPTION

Figure 1:
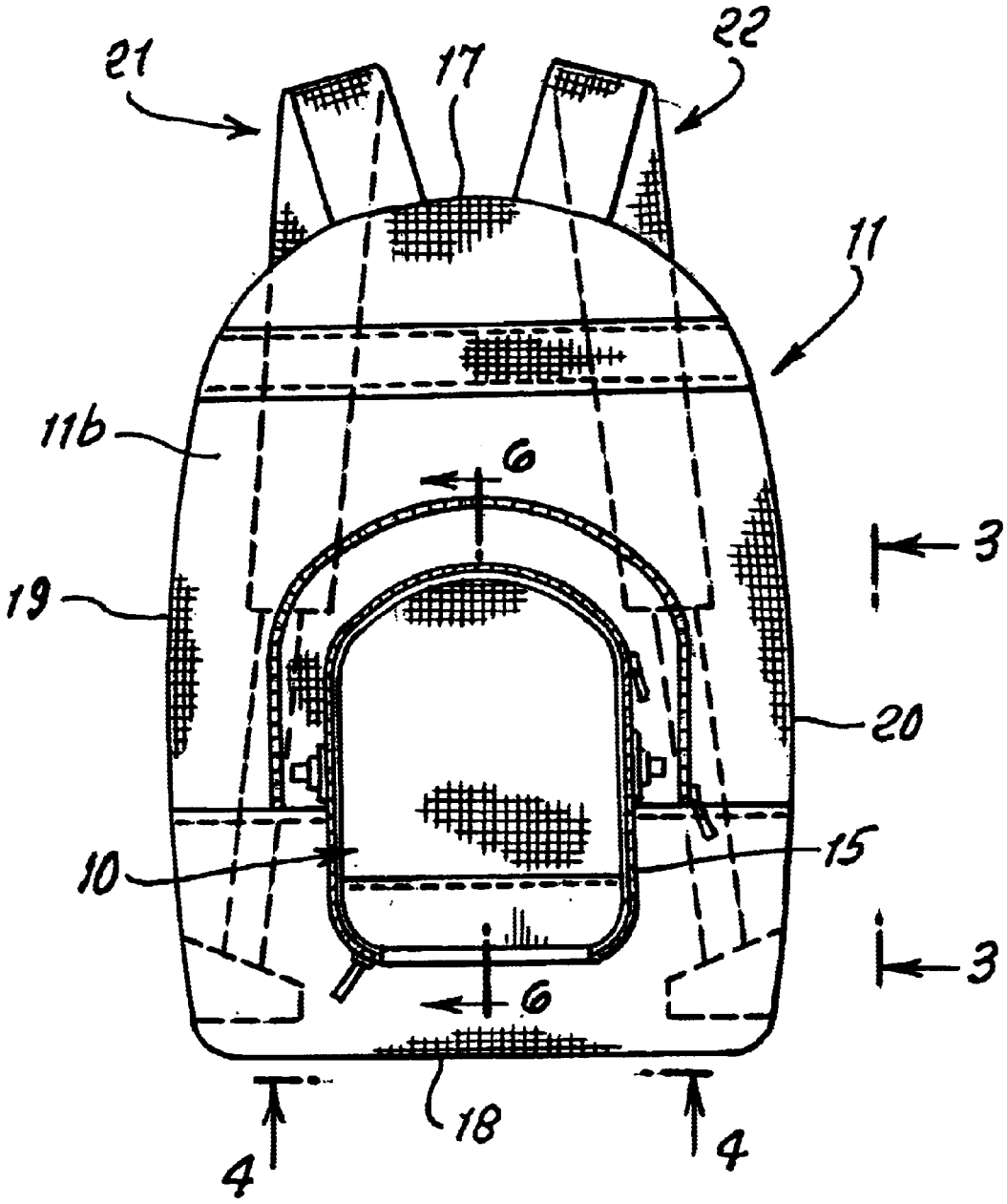
FIG. 1 is a first elevational view of an enclosure or case showing attachment to a carrier, such as a back pack.
Figure 3:
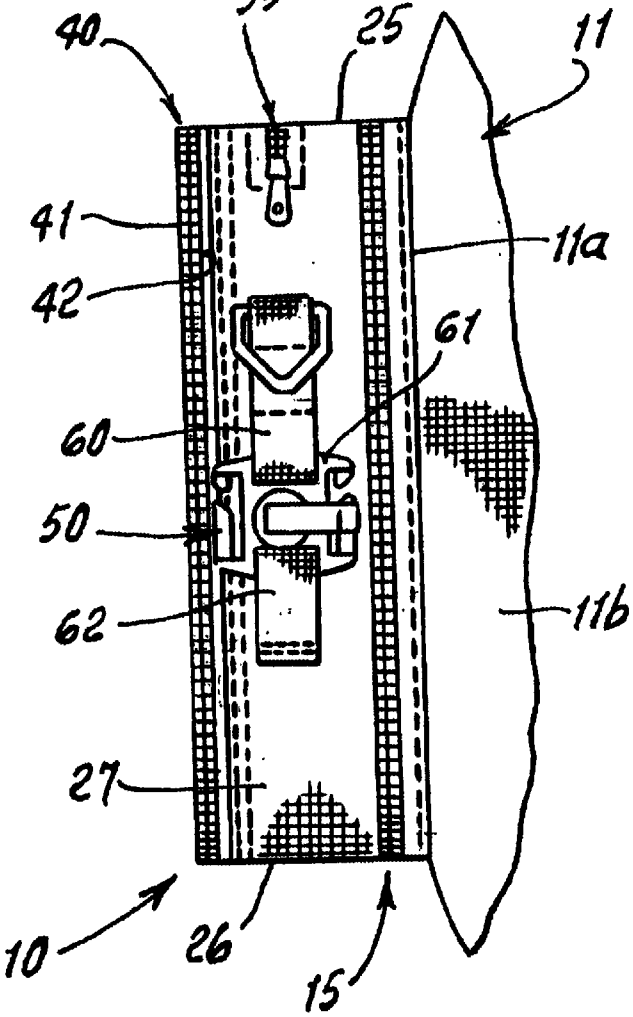
FIG. 3 is an enlarged side view taken on lines 3—3 of FIG. 1.
Figure 2:
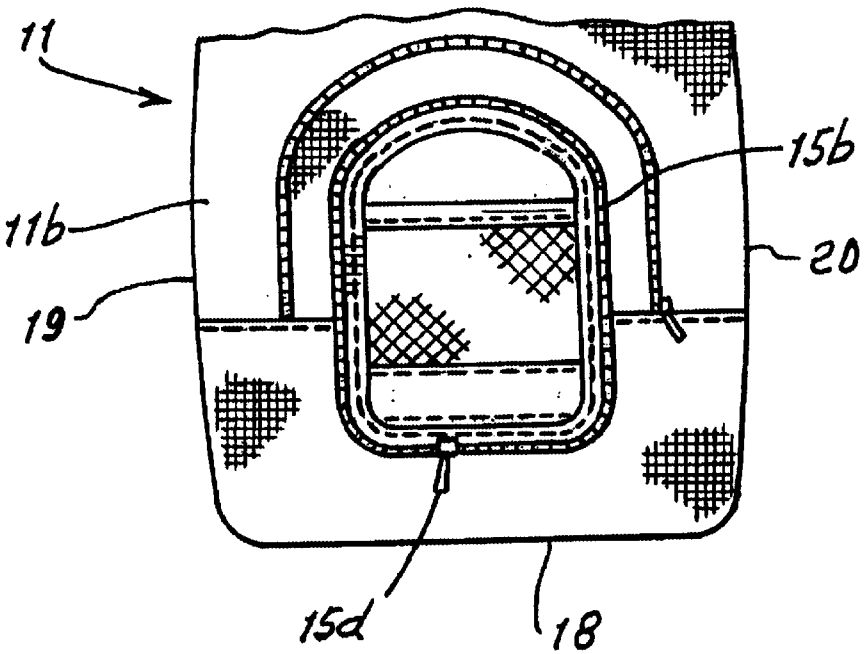
FIG. 2 is a view like FIG. 1, but with the enclosure or case removed from the illustrated rear side of the back pack.
Figure 4:
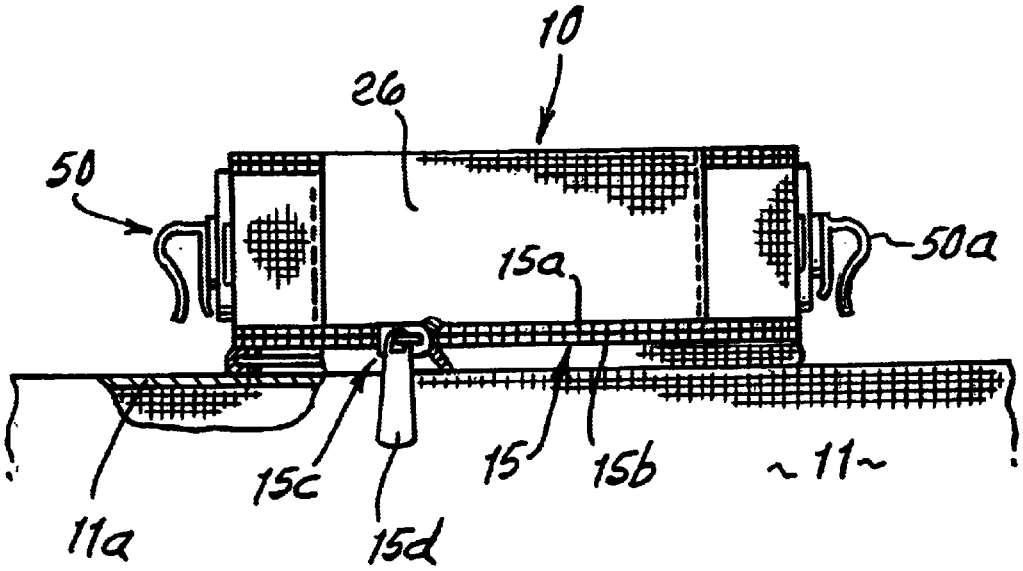
FIG. 4 is a bottom plan view taken on lines 4—4 of FIG. 1.
Figure 5:
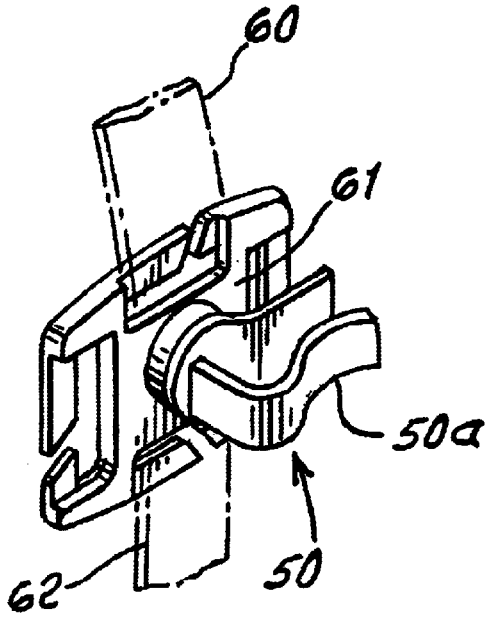
FIG. 5 is a perspective view showing details of a clip, as in also seen in side view in FIG. 3.
Figure 10:
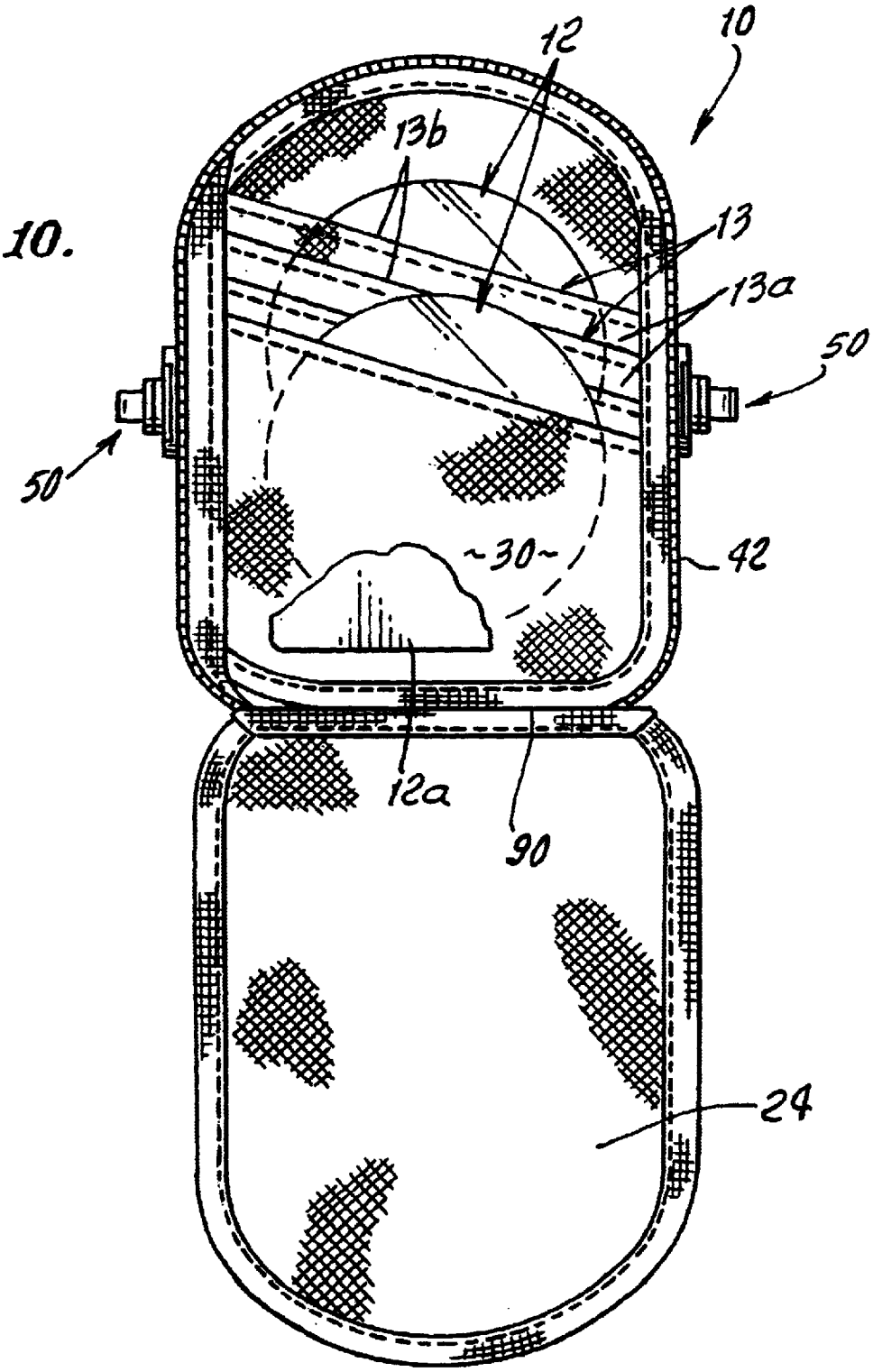
FIG. 10 is a frontal view of the FIG. 8 case, but opened up by unzipping of a front flap which is lowered, to show case interior structure for supporting compact discs with room provided for a CD player.

Referring first to FIGS. 1–4, an enclosure is shown at 10 removably attached to a container, such as the back pack 11, illustrated. As seen in FIG. 10, the enclosure 10 is typically especially adapted to store compact discs, i.e. CD's 12 and/or a player unit 12*a* for such discs. See also FIG. 11. The discs fit within pockets 13 formed by overlaying layers 13*a* of flexible material forming entrances 13*b* for individual discs. Other associated equipment may be stored within the enclosure 10, for transport. The attachment structure as seen in FIGS. 4 and 5 preferably comprises zipper structure 15, including a zipper track 15*a* on the enclosure, a zipper track 15*b* on the rear wall 11*a* of the pack 11, and a zipper 15*c* slidable along the two tracks to interfit them. See zipper handle 15*d*, in FIG. 4.

The back pack 11 may include a housing 11*b* of which rear wall 11*a* is a component; a top wall 17, bottom wall 18, and side walls 19 and 20. See FIG. 1. Shoulder straps 21 and 22 are attached to the housing 11*b*, for assembly on the shoulders of the back pack wearer.

Figure 6:
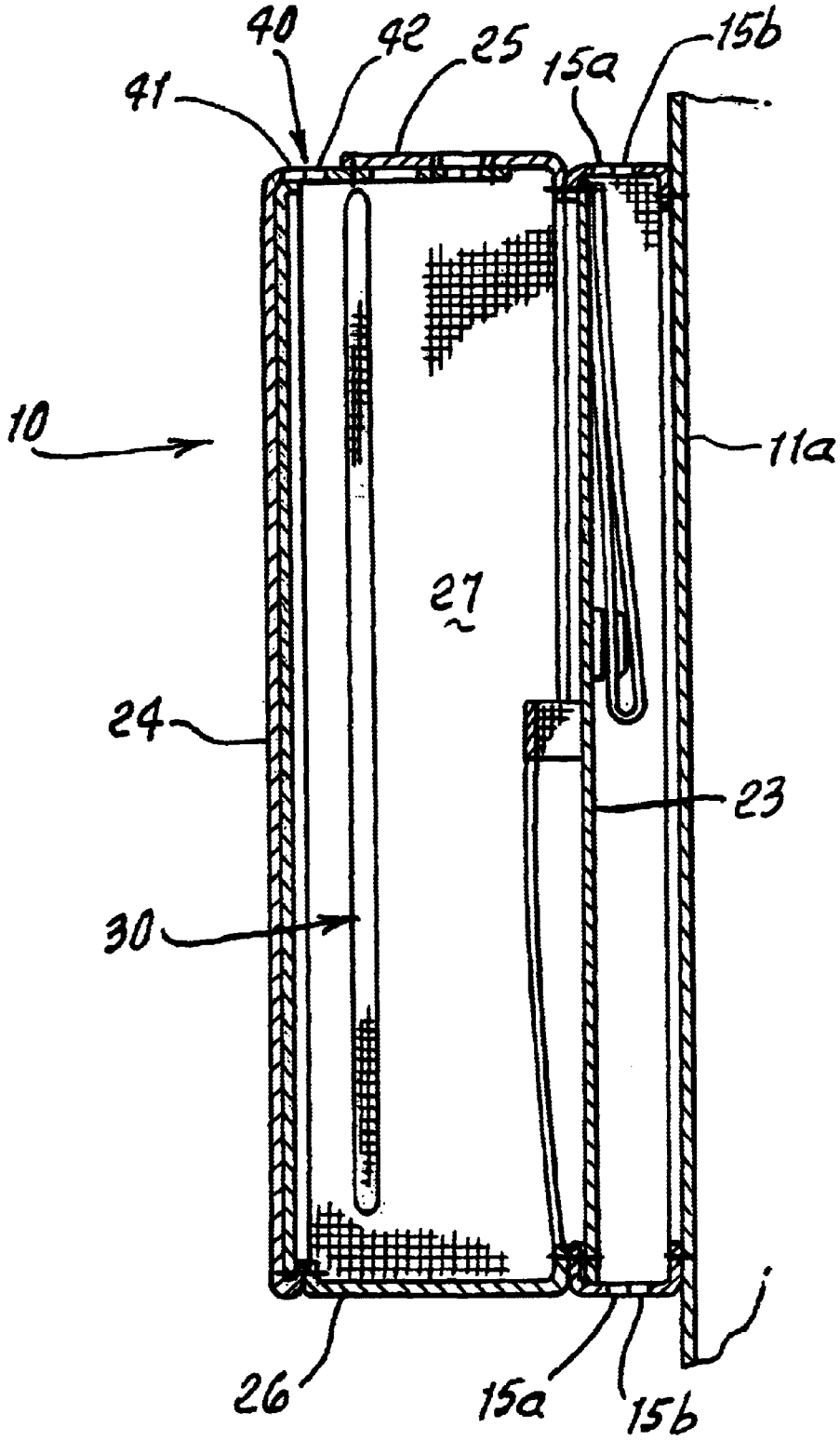
FIG. 6 is a vertical section taken on lines 6—6 of FIG. 1.
Figure 7:
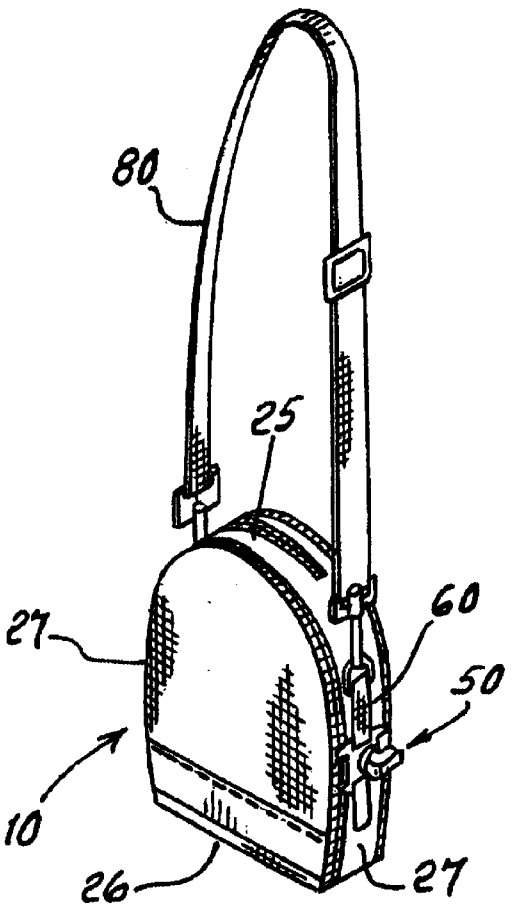
FIG. 7 is a perspective view of the enclosure or case, separated from the carrier, and with an attached carrying strap.
Figure 9:
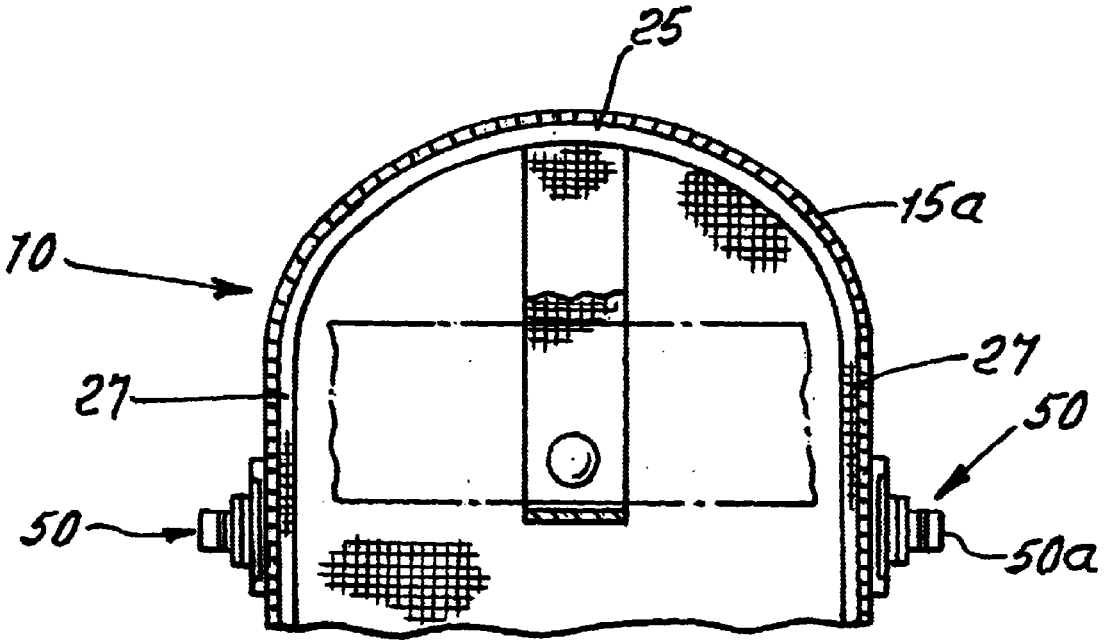
FIG. 9 is a rear view of an upper portion of the enclosure or case.

The enclosure 10 as seen in FIGS. 6 and 7 has a forward facing wall 23 facing the pack rear wall 11*a*; a rear wall 24, and top, bottom and side walls 25, 26 and 27. Wall 23 closest to the pack 11 has a looping periphery, as shown; and the zipper track 15*a* extends lengthwise of and proximate that periphery, i.e. along a looping path. Track 15*b* extends parallel to track 15*a*, so that when interconnected, the two tracks hold the front side of wall 23 closely proximate the facing extent of pack rear wall 11*a*. When tracks 15*a* and 15*b* are disconnected, the enclosure 10 is removed from attachment to the back pack, and it may be separately carried about, and used.

The enclosure has two sections that are relatively openable for allowing reception of a device or devices into the enclosure, or their removal. As referred to, such device or devices may comprise a component disc or discs, a compact disc player, and/or other related electronic video or communication equipment. Such two sections may comprise the rear wall 24, and the walls 25–27 away from which rear wall is movable or openable as seen in FIGS. 10 and 11 to allow access to the interior of the enclosure, and devices therein.

Figure 11:
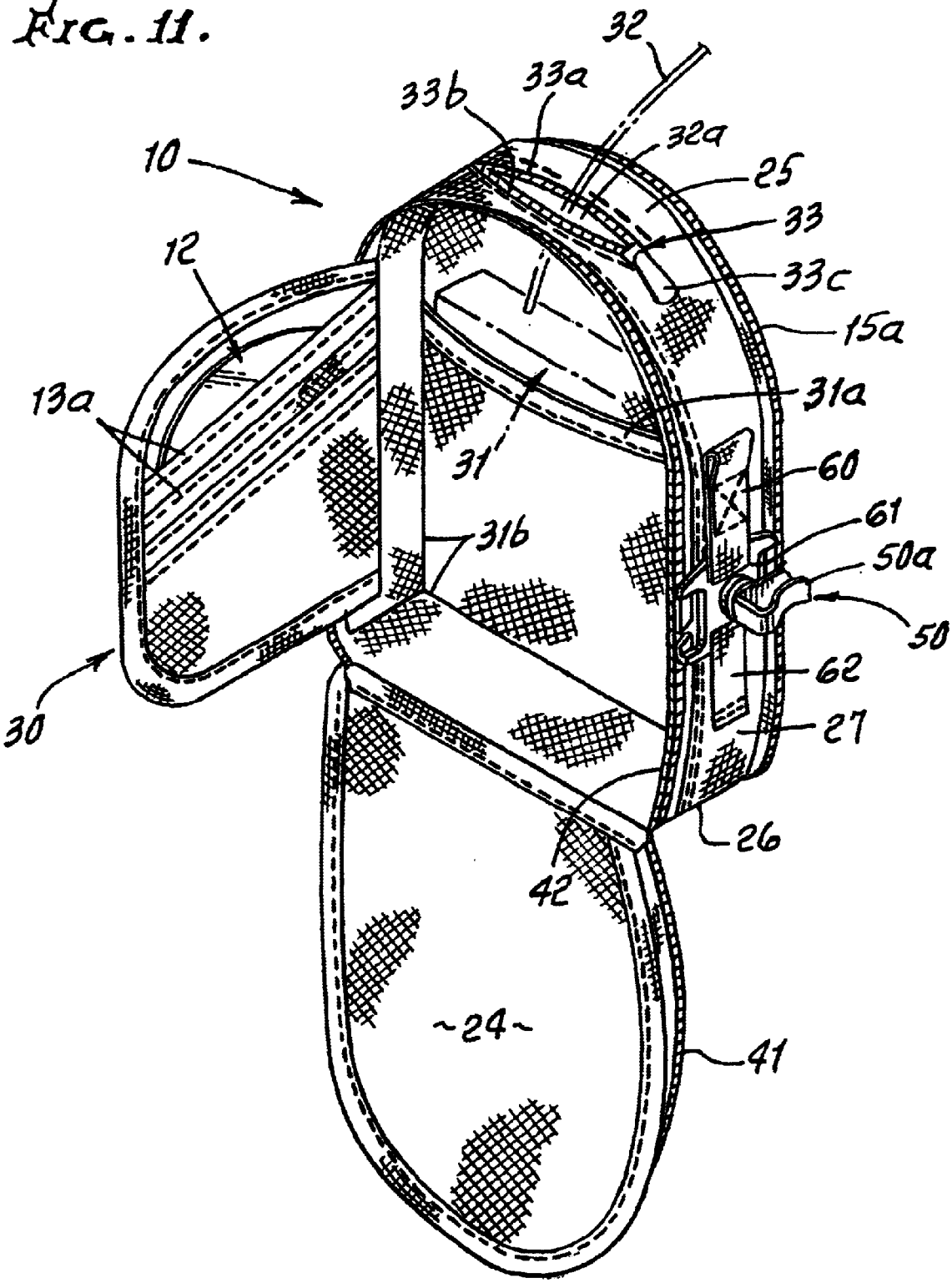
FIG. 11 is a perspective view of the opened-up case, showing both interior and exterior structure.

FIG. 11 shows compact discs 12 stored in pockets 13*a* located on a foldable flap 30 carried by the enclosure, and a compact disc player (or other electronic equipment) housing 31 stored interiorly of the enclosure behind a flap 31*a* edge connected at 31*b* to the enclosure. A communication wire or cable 32 extends from the player or unit 31 through an access opening 32*a* formed in enclosure top wall 25, openable and closable by a zipper structure 33, including tracks 33*a* and 33*b*, and a zipper having a handle 33*c*.

The two sections of the enclosure (openable wall 24, and walls 25–27) are removably interconnected as by a zipper structure 40, seen in FIG. 3, that includes looping track 41 on wall 24, and looping track 42 on walls 25 and 27, as shown. The looping tracks 41 and 42 bound the interior 43 of the enclosure, and they extend in generally parallel, spaced apart relation to tracks 15*a* and 15*b* described above. In this regard, walls 25–27 extend between tracks 41 and 42, and tracks 15*a* and 15*b*. If desired, the bottom or adjacent edge portions of walls 24 and 26 may be foldably connected as at 90, in FIG. 10.

Figure 8:
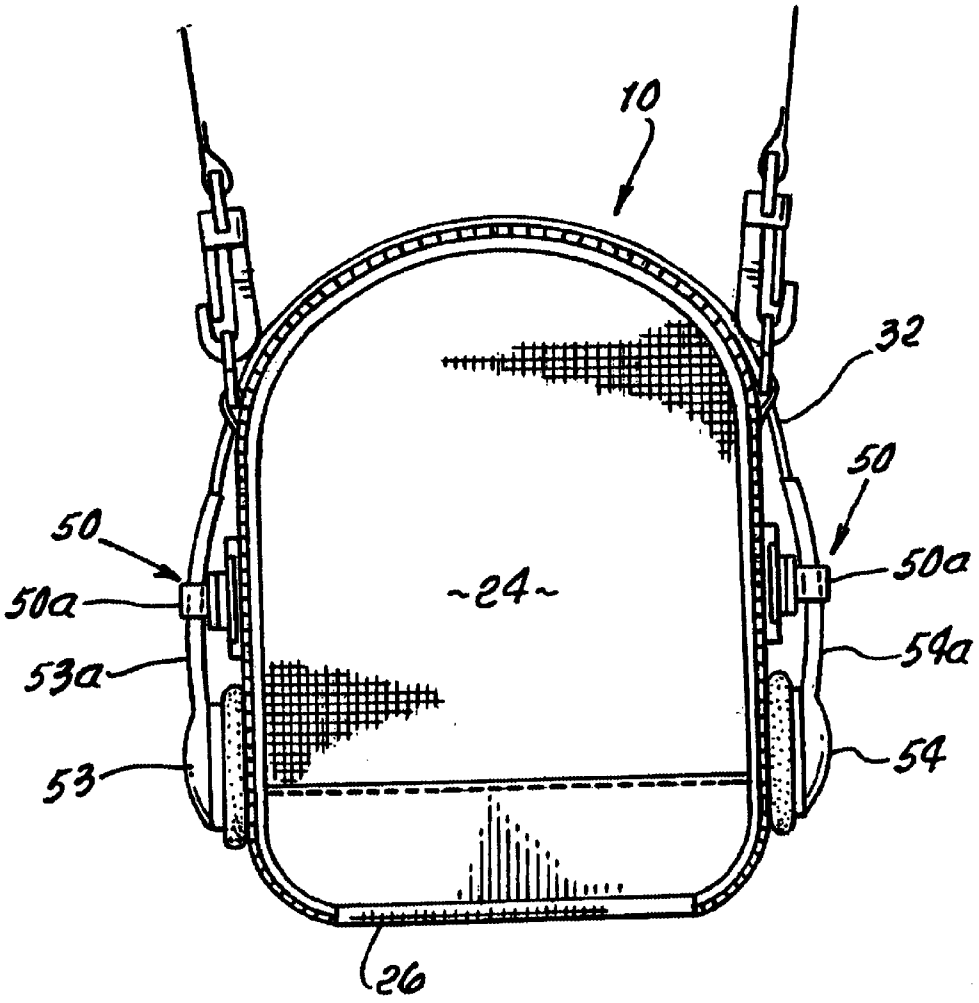
FIG. 8 is a frontal view of the enclosure or case itself, with head phone device attached.

A retainer or retainers 50 are carried by the enclosure, as on a side wall 25, or both side walls 27, for removably supporting electronic equipment to which cable or cable sections 32 are connected, as seen in FIG. 8. That equipment may include head set speakers 53 and 54, having stems 53*a* and 54*a* removably attached to retainer clips 50*a*, as shown in FIG. 8, and also in FIG. 4, for storage of the head set, to the enclosure, and separate transport with the enclosure when the latter is detached from the back pack, or other carrier device.

FIG. 7 shows a carrier strap 80 separately attached to the side walls 27 of the enclosure, as via adjustable connectors 60, 61 and 62. Elements 61 may be attached to the retainers 50, as shown in FIG. 7.

Figure 12:
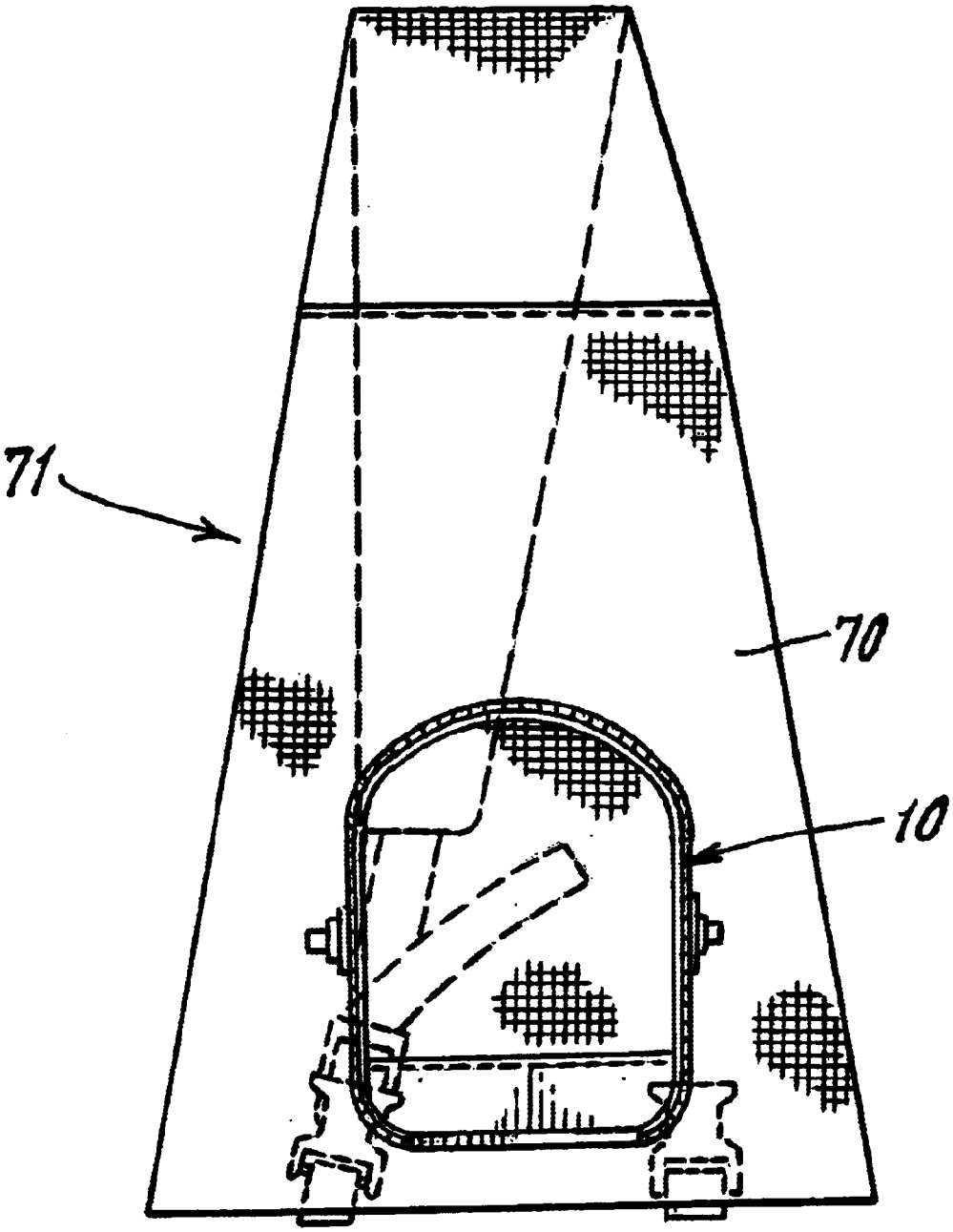
FIG. 12 is a rear view of a modified back pack, to which a case or enclosure, as referred to, is attached.

FIG. 12 shows attachment of the enclosure 10, as described above, to the rear wall 70 of a back pack 71, of the type described in U.S. Pat. No. 5,769,295.

Figure 13:
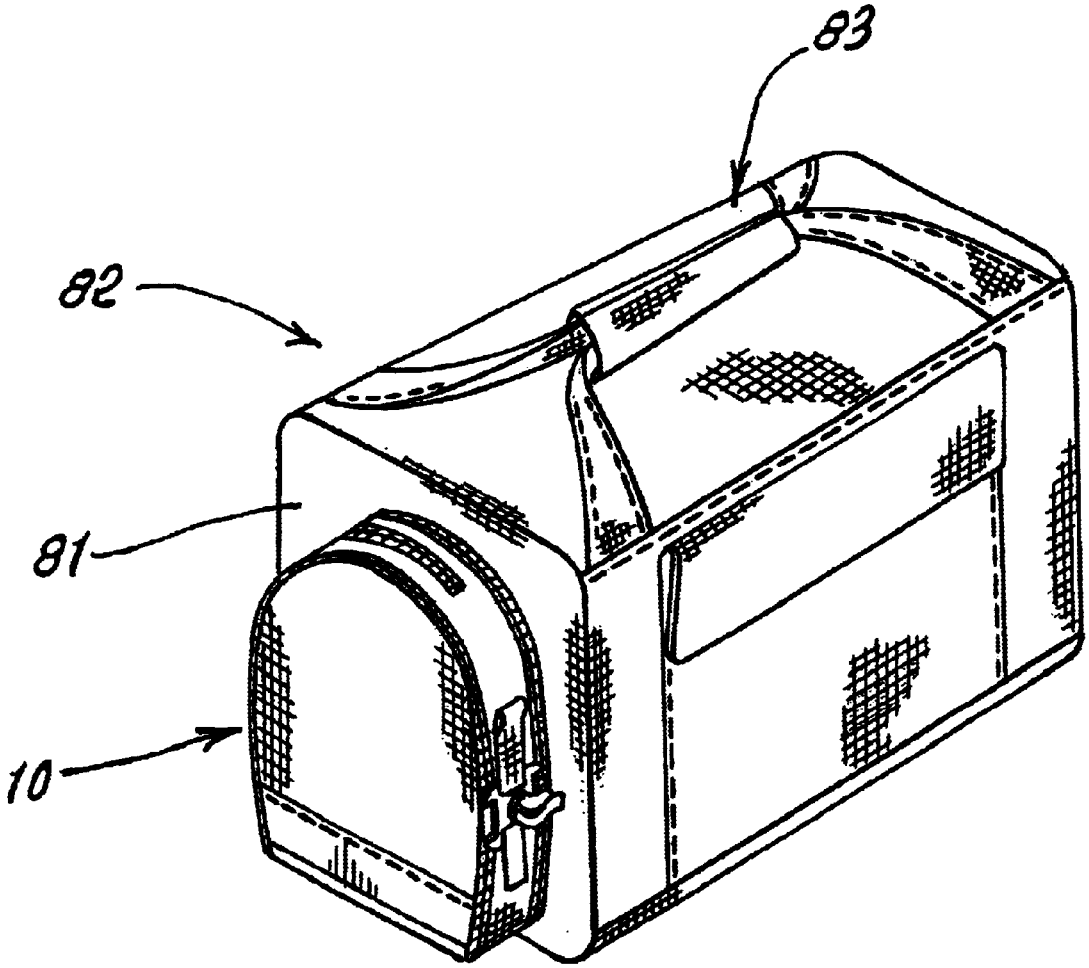
FIG. 13 is a perspective view of a luggage item, having and end wall to which the case, as described, is removably attached as by zipper structure.

FIG. 13 shows attachment of the enclosure 10, as described above, to the end wall 81 of a luggage unit 82, having a handle 83. Accordingly, the same enclosure 10 can be selectively attached to many different types or shapes of carrier equipment, as desired.

We claim:

1. In combination:

a) a carrier pack, b) an enclosure for a device comprising at least one of the following:

$x_1$) a compact disc or discs, $x_2$) a compact disc player, $X_3$) a component or components related to said disc or said player, c) releasable attachment structure carried on the pack and on the enclosure whereby the enclosure can be bodily removably attached to, or removed from the pack, d) said enclosure having an interior and there being a hinged flap carried by said enclosure and facing said interior to extend in supporting relation to said device.

2. The combination of claim 1 wherein said attachment structure is a first zipper and first zipper tracks carried by the enclosure and on the pack.

3. The combination of claim 2 wherein said enclosure has a wall facing the pack, said wall having a periphery, and said first zipper track carried by the enclosure extends proximate said periphery.

4. The combination of claim 1 including a retainer or retainers on the enclosure, that removably support a head set which includes at least one speaker.

5. The combination of claim 1 wherein the carrier pack is a back pack, including a carrier strap attached to the pack.

6. The combination of claim 1 wherein the carrier is one of the following:

i) luggage ii) a cooler unit.

7. The combination of claim 1 wherein the enclosure is a case having an interior wall, and pockets on said wall for reception of multiple compact discs.

8. The combination of claim 1 wherein said enclosure has two sections that are relatively openable for allowing reception of said device into the interior of the enclosure, and for removal of the device from said interior.

9. The combination of claim 8 wherein said attachment structure is a first zipper and first zipper tracks carried by the enclosure and on the pack.

10. The combination of claim 9 including second zipper structure including a second zipper, and second zipper tracks carried on two sections of the enclosure.

11. The combination of claim 10 wherein said second zipper tracks bound an interior portion of the enclosure.

12. The combination of claim 10 wherein the first zipper tracks and second zipper tracks extend in generally parallel, spaced apart relation.

13. The combination of claim 10 wherein one of the enclosure sections has a wall extending between the first and second zipper tracks.

14. The combination of claim 13 including a through opening in one of said sections, spaced from said first and second zipper tracks.

15. The combination of claim 14 including wiring extending through said opening, for allowing electrical communication between said device in the enclosure and an electrically operable speaker outside the enclosure.

16. The combination of claim 15 including said speaker, which is a head set there being a retainer or retainers on the enclosure, to removably support a head set.

17. In combination a) first and second carriers, each carrier having a carrier handle, b) an enclosure for a device comprising at least one of the following:

$x_1$) a compact disc or discs, $x_2$) a compact disc player, $x_3$) a component or components related to said disc or said player, c) attachment structure on each carrier, and on the enclosure, whereby the enclosure can be selectively attached to, or removed from, either of the carriers.

18. The combination of claim 17 wherein one carrier is a back pack.

19. The combination of claim 17 herein one carrier is a cooler.

20. For combination with a carrier, the combination comprising a) an enclosure for a device comprising at By, least one of the following:

$x_1$) a compact disc or discs, $x_2$) a compact disc player, $x_3$) a component or components related to said disc or said player, b) releasable attachment structure carried by the enclosure, whereby the enclosure can be attached to or bodily removed from the carrier, c) said enclosure having an interior and there being a flap hingedly carried by said enclosure and facing said interior to extend in position supporting relation to said device, d) and a series of pockets carried by said flap to receive compact discs.

21. The combination of claim 20 wherein said attachment structure includes a first zipper and a first zipper track carried by the enclosure to be zip connected to a first zipper track on the carrier.

22. The combination of claim 21 wherein the enclosure, has a wall to face the carrier, said wall having a periphery, and said first zipper track extends about at least a portion of said periphery.

23. The combination of claim 20 wherein said enclosure has two sections that are relatively openable for allowing reception of said device into the interior of the enclosure, and for removal of the device from said interior.

24. The combination of claim 23 wherein said attachment structure is a first zipper and first zipper tracks carried by the enclosure and by the pack.

25. The combination of claim 24 including second zipper structure including a second zipper and second zipper tracks on the two sections.

26. The combination of claim 25 wherein the first zipper tracks and second zipper tracks extend in generally parallel, spaced apart relation.

27. The combination of claim 25 wherein one of the enclosure sections has a wall extending between the first and second zipper tracks.

28. The combination of claim 27 including a through opening in one of said sections, spaced from said first and second zipper tracks.

29. The combination of claim 28 including wiring extending through said opening, for allowing electrical communication between said device in the enclosure and an electrically operable speaker outside the enclosure.

30. The combination of claim 29 including said speaker, which is a head set.

31. The combination of claim 30 including a retainer on the enclosure, to removably support the head set.

32. In combination:

a) a carrier pack, b) an enclosure for a device comprising a compact disc or discs, c) releasable attachment structure carried on the pack and on the enclosure whereby the enclosure can be bodily removably attached to, or removed from the pack, the enclosure being openable when attached to the pack and also when completely removed from the pack, d) said enclosure having an interior and a wall facing said interior, there being a pocket or pockets carried by said wall for reception of said compact disc or discs, and for access when the enclosure is opened.

33. The combination of claim 32 wherein said attachment structure is a first zipper and first zipper tracks carried by the enclosure and by the pack.

34. The combination of claim 33 including said device within said enclosure interior and received by said pocket or pockets.

* * * * *